US012685890B2

(12) United States Patent
Sterling

(10) Patent No.: US 12,685,890 B2
(45) Date of Patent: Jul. 21, 2026

(54) ADJUSTABLE PHYSICAL THERAPY AND EXERCISE KIT

(71) Applicant: Mike Sterling, Visalia, CA (US)

(72) Inventor: Mike Sterling, Visalia, CA (US)

( * ) Notice: Subject to any disclaimer, the term of this patent is extended or adjusted under 35 U.S.C. 154(b) by 94 days.

(21) Appl. No.: 18/590,078

(22) Filed: Feb. 28, 2024

(65) Prior Publication Data

US 2025/0269219 A1 Aug. 28, 2025

(51) Int. Cl.
*A63B 21/045* (2006.01)
*A63B 21/072* (2006.01)
*A63B 21/075* (2006.01)

(52) U.S. Cl.
CPC ..... *A63B 21/045* (2013.01); *A63B 21/0724* (2013.01); *A63B 21/0728* (2013.01); *A63B 21/075* (2013.01); *A63B 2209/10* (2013.01)

(58) Field of Classification Search
CPC ..... A63B 21/045; A63B 21/0724; A63B 21/0728; A63B 21/075; A63B 21/002–0023; A63B 2209/10
See application file for complete search history.

(56) References Cited

U.S. PATENT DOCUMENTS 405,128 A * 6/1889 Stockburger ..... A63B 21/0724 482/106
5,147,262 A * 9/1992 Hymanson ..... A63B 21/072 482/121
5,735,777 A * 4/1998 Benoit ..... A63B 21/0728 482/106
5,891,003 A * 4/1999 Deac ..... A63B 5/16 482/106
7,708,671 B2 * 5/2010 Burkhardt ..... A63B 21/027 482/106
7,722,510 B2 * 5/2010 Jhu ..... A63B 21/027 482/106
7,909,744 B2 * 3/2011 Eck ..... A63B 21/045 482/106
8,454,482 B2 6/2013 Chang
8,485,949 B2 * 7/2013 Hsu ..... A63B 21/027 482/121
8,597,166 B2 * 12/2013 Klein ..... A63B 21/027 482/109
D843,507 S 3/2019 Cook
10,369,401 B2 * 8/2019 Brown, Jr. ..... A63B 21/0724
11,224,778 B2 * 1/2022 Cook ..... A63B 21/0004
D961,697 S 8/2022 Alba
2002/0198476 A1 * 12/2002 Chen ..... A61H 7/003 601/84

(Continued)

FOREIGN PATENT DOCUMENTS

WO WO2011149441 12/2011

*Primary Examiner* — Megan Anderson
*Assistant Examiner* — Kathleen M Fisk

(57) ABSTRACT

An adjustable physical therapy and exercise kit includes a bar, a holding structure, and a plurality of weights. A user can move the bar in an oscillating manner to cause the bar to flex and move back and forth to exercise parts of the body of a user. The plurality of weights is designed to be detachably connected to the bar at the first end portion and the second end portion. The weights are attachable and detachable to permit a therapist or a user to vary the total weight in accordance with a physical therapy or exercise program suitable for the user's strength, health, age, and/or physical therapy or exercise needs.

17 Claims, 6 Drawing Sheets

(56) References Cited

U.S. PATENT DOCUMENTS

| | | | | |
|---|---|---|---|---|
| 2004/0242387 | A1* | 12/2004 | Benach | A63B 21/00043<br>482/121 |
| 2007/0135275 | A1* | 6/2007 | Oates | A63B 21/0004<br>482/109 |
| 2009/0264267 | A1 | 10/2009 | Ballif | |

* cited by examiner

ADJUSTABLE PHYSICAL THERAPY AND EXERCISE KIT

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to physical therapy and exercise devices and more particularly pertains to a new adjustable physical therapy and exercise kit for users of different strength and fitness levels, especially those who are elderly or have lower strength and overall fitness. Oscillating fitness bars can be used for targeted exercise of muscles groups by generating multiple muscle contractions quickly in a short period of time. In operation, a user usually grabs an elongated bar, which is flexible and usually weighted at the ends. The user grasps the center region and moves the bar back and forth causing the bar to flex and the ends to oscillate. This motion generates forces and the user must use his or her muscles to resist these forces and control the bar. However, current models are heavy and can be difficult to handle for those who are elderly or of limited strength. In addition, the devices have a fixed design so the user has no ability to vary the weight and/or stiffness of the bar. A variable design would be useful in different situations, such as a home or physical therapy clinic with multiple users, or in the case of an individual whose strength and/or fitness level improves or declines, thereby necessitating a different type of exercise program and corresponding bar.

(2) Description of Related Art Including Information Disclosed Under 37 CFR 1.97 and 1.98

The prior art relates to physical therapy and exercise devices. The prior art, as best understood, does not disclose an oscillating bar for physical therapy and exercise that has a variable design to allow for changes in weight and/or stiffness for different users or different strength and fitness levels.

(h) BRIEF SUMMARY OF THE INVENTION

An embodiment of the disclosure meets the needs presented above in an adjustable physical therapy and exercise kit generally comprising a bar, a holding structure, and a plurality of weights. The bar is elongated and resiliently flexible. The bar includes a first end portion and a second end portion. The holding structure is positioned on a central portion of the bar and designed to permit a user to manually grip and hold the bar and move the bar in an oscillating manner to cause the bar to flex and the first end portion and the second end portion to move back and forth and thereby generate forces that cause muscle contractions in parts of the body of a user to exercise parts of the body of a user. The plurality of weights is designed to be detachably connected to the bar at the first end portion and the second end portion to cause greater flexing of the bar and greater forces on parts of the body to exercise parts of the body in a more strenuous manner than would occur with solely the bar. Each of the plurality of weights is attachable and detachable to the bar to permit a therapist or a user to vary the total weight at each of the first end portion and the second end portion in accordance with a physical therapy or exercise program suitable for the user's strength, health, age, and/or physical therapy or exercise needs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
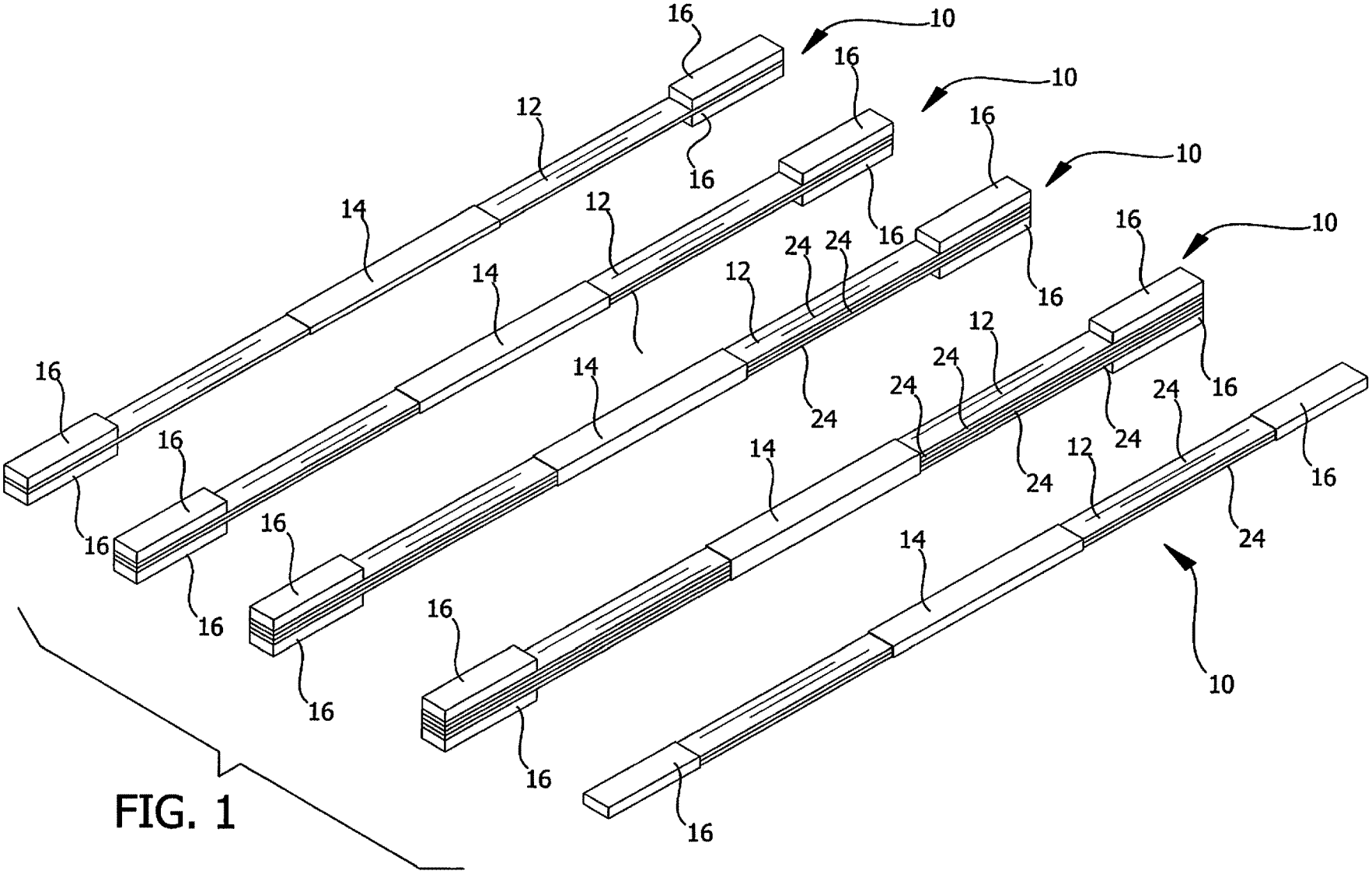
FIG. 1 is a perspective view of an adjustable physical therapy and exercise kit according to an embodiment of the disclosure.

With reference now to the drawings, and in particular to FIGS. 1 through 6 thereof, a new adjustable physical therapy and exercise kit embodying the principles and concepts of an embodiment of the disclosure and generally designated by the reference numeral 10 will be described.

Figure 2:
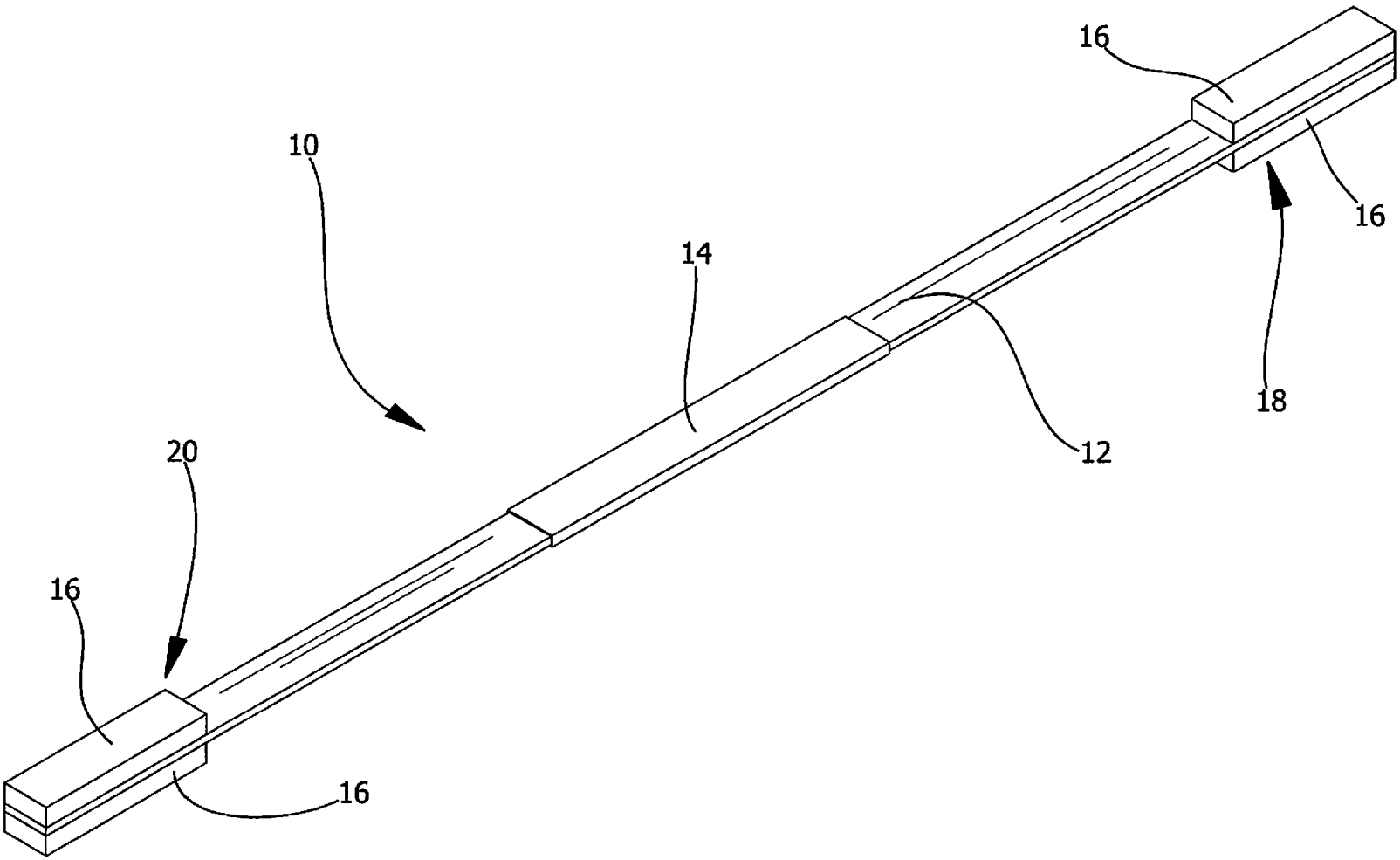
FIG. 2 is a perspective view of an embodiment of the disclosure.
Figure 3:
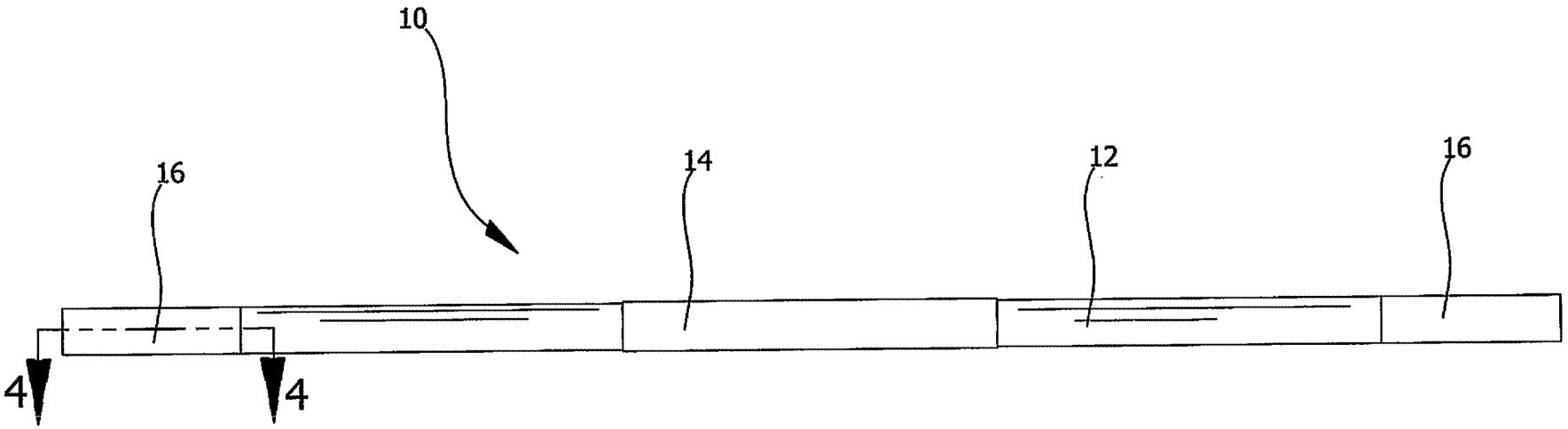
FIG. 3 is a side view of an embodiment of the disclosure.
Figure 4:
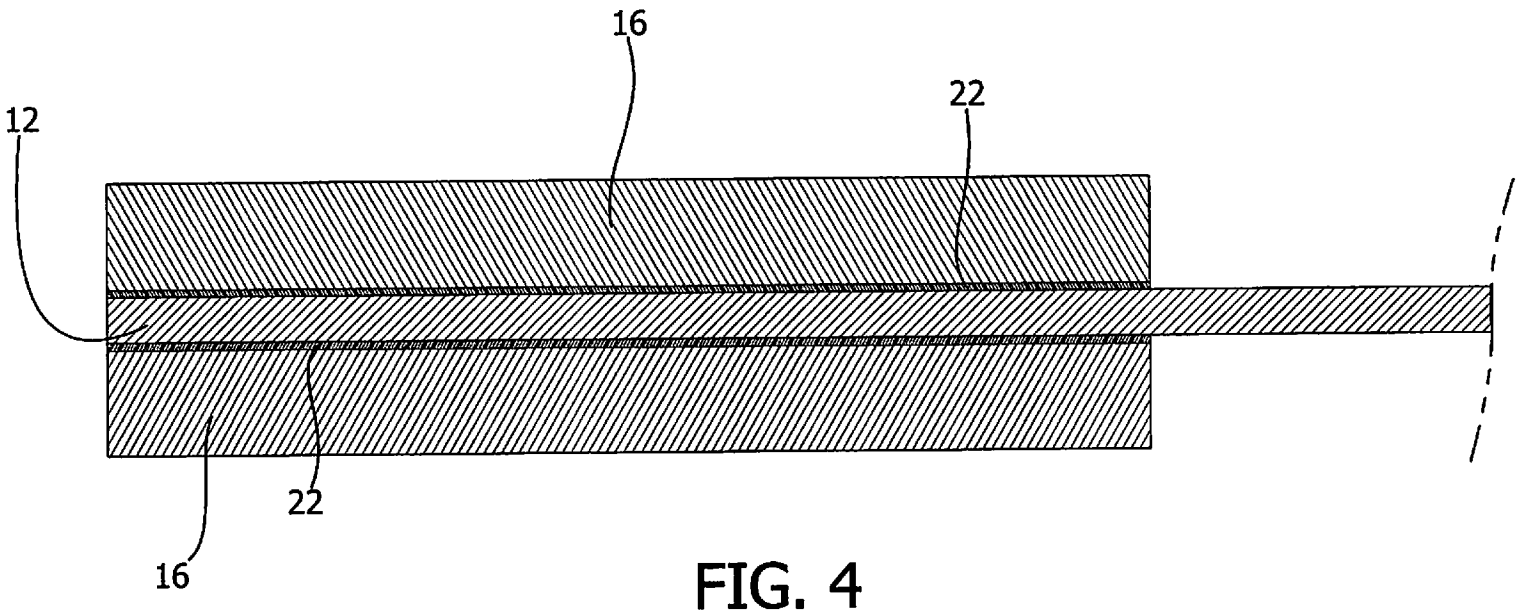
FIG. 4 is a cross-sectional view of an embodiment of the disclosure.
Figure 5:
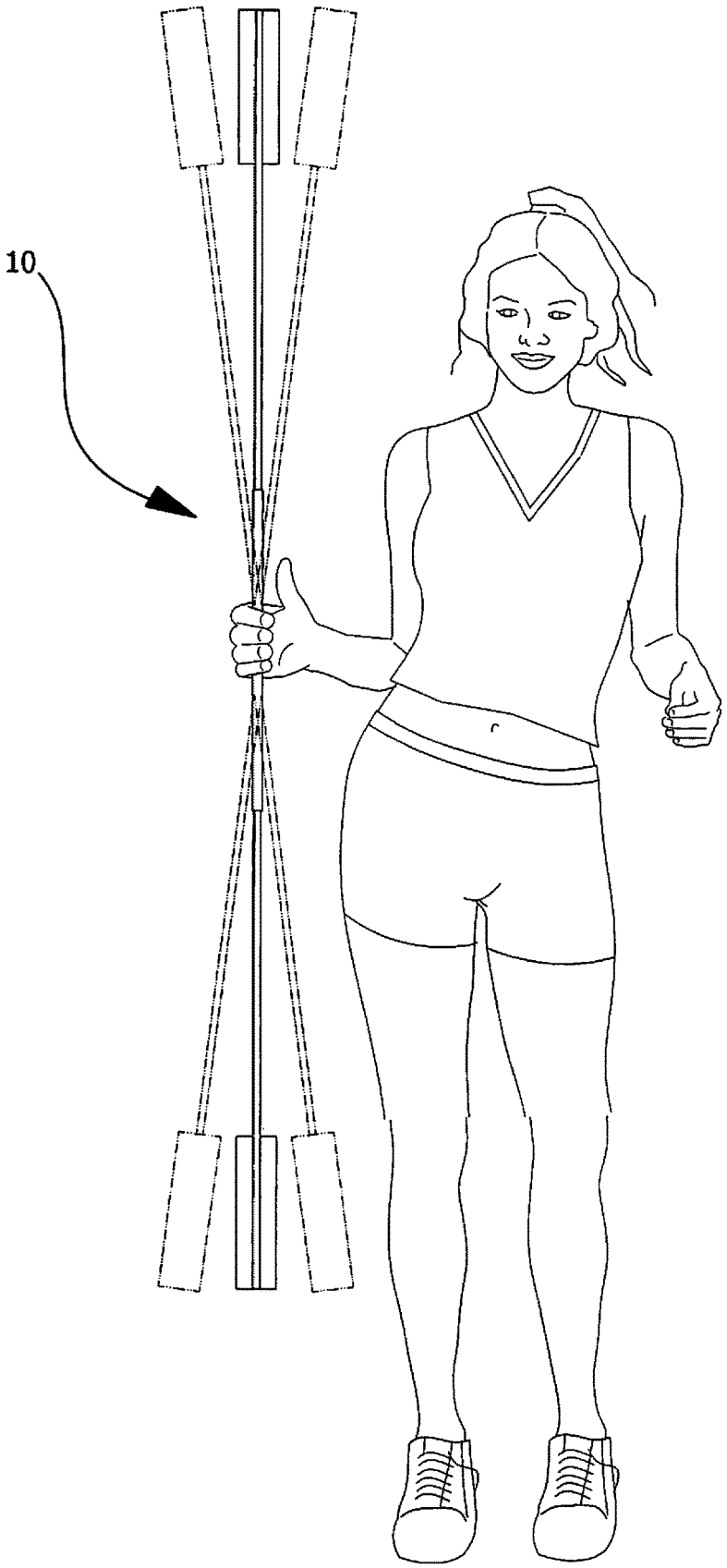
FIG. 5 is a view of an embodiment of the disclosure in use.

As best illustrated in FIGS. 1 through 6, the adjustable physical therapy and exercise kit 10 generally comprises a bar 12, a holding structure 14, and a plurality of weights 16. FIG. 1 shows a variety of designs of the bar 12 and weights 16, which will be discussed further herein. FIG. 2 shows a base design. The bar 12 is elongated and resiliently flexible. The bar 12 includes a first end portion 18 and a second end portion 20. The holding structure 14 is positioned on a central portion of the bar 12 and designed to permit a user to manually grip and hold the bar 12 and move the bar 12 in an oscillating manner to cause the bar 12 to flex and the first end portion 18 and the second end portion 20 to move back and forth and thereby generate forces that cause muscle contractions in parts of the body of a user to exercise parts of the body of a user, as shown in FIG. 5. The plurality of weights 16 is designed to be detachably connected to the bar 12 at the first end portion 18 and the second end portion 20 to cause greater flexing of the bar 12 and greater forces on parts of the body to exercise parts of the body in a more strenuous manner than would occur with solely the bar 12. Each of the plurality of weights 16 is attachable and detachable to the bar 12 to permit a therapist or a user to vary the total weight at each of the first end portion 18 and the second end portion 20 in accordance with a physical therapy or exercise program suitable for the user's strength, health, age, and/or physical therapy or exercise needs.

In accordance with at least one possible embodiment, the bar 12 includes layers of hook-and-loop material 22 designed to detachably connect with layers of hook-and-loop material 22 on the plurality of weights 16, as shown in FIG. 4. One of the layers of hook-and-loop material 22 is positioned on opposing surfaces of each of the first end portion 18 and the second end portion 20 to permit detachable connection of weights 16 on the opposing surfaces. It should be understood though that the weights 16 could be permanently or semi-permanently attached to the bar 12 by adhesive or similar bonding or attachment structures or materials.

Figure 6:
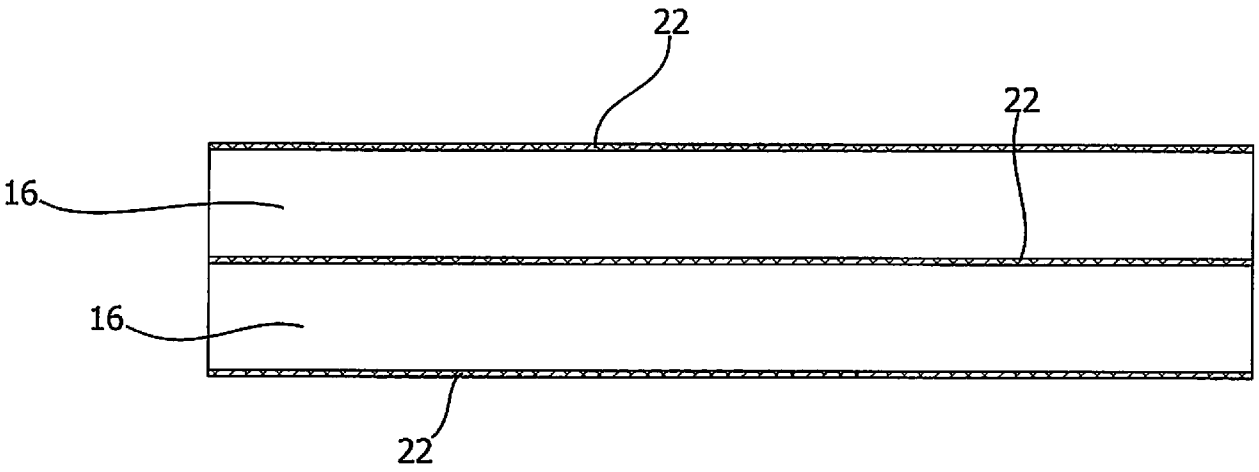
FIG. 6 is a side view of a portion of an embodiment of the disclosure.

In accordance with at least one possible embodiment, each of the plurality of weights 16 includes two layers of hook-and-loop material 22 on opposing sides to permit detachable connection of weights 16 in a stacked manner, as shown in FIG. 6. While hook-and-loop material 22 is disclosed herein, other suitable connection materials and components are contemplated by the disclosure. For example, two weights 16 could be connected by an elastic material to allow the weights 16 to be slid over and snapped in place on the bar 12 by the return force of the elastic material. For example, the bar 12 could have magnetic layers.

In accordance with at least one possible embodiment, the bar 12 is in the shape of an elongated rectangular strip and the weights 16 are in the shape of rectangular blocks. Other suitable shapes are contemplated by the disclosure.

In accordance with at least one possible embodiment, the bar 12 and the weights 16 comprise wood or plastic or composite material.

In accordance with at least one possible embodiment, each of the weights 16 is approximately 0.25 to 0.625 inch thick, is approximately 1.25 to 1.75 inches wide, is approximately 2 to 6 inches long, and weighs approximately 0.5 to 1.0 ounce. The preceding ranges include all whole numbers, tenths, and hundredths.

In accordance with at least one possible embodiment, the plurality of weights 16 includes at least two weights 16 each having a different weight. In accordance with at least one possible embodiment, the weights 16 comprise a set of small weights 16, a set of medium weights 16 that are heavier than the small weights 16, and a set of large weights 16 that are heavier than the medium weights 16. For example, the adjustable physical therapy and exercise kit 10 could have 12 different weights 16, wherein four are the same weight and eight are the same weight as each other but different from the other four. Any number of different or same weights 16 could be in the adjustable physical therapy and exercise kit 10.

In accordance with at least one possible embodiment, the bar 12 includes a plurality of bar layers 24 that are stackable to permit formation of a bar 12 of different thicknesses and stiffnesses. Examples are shown in FIG. 1, wherein the bar 12 is shown with two, three, and four bar layers 24. The holding structure 14 includes a wrap made of fabric or elastic material and designed to be wrapped around the bar layers 24 to hold the bar layers 24 together. The wrap includes one of: adhesive material to semi-permanently connect the bar layers 24 together or hook-and-loop material 22 to detachably connect the bar layers 24 together. In other words, any type of strong adhesive tape could be used to connect the bar layers 24 in situations where the user is very unlikely to want to change the thickness of the bar 12, whereas the hook-and-loop material 22 would be useful in situations where frequent changes of the thickness of the bar 12 are desired.

In accordance with at least one possible embodiment, each of the bar layers 24 is approximately 0.2 to 0.3 inch thick, is approximately 1.25 to 1.75 inches wide, is approximately 40 to 56 inches long, and weighs approximately 5 to 8 ounces. The preceding ranges include all whole numbers, tenths, and hundredths.

The adjustable physical therapy and exercise kit 10 can be used by individuals either at home, in a gym, or in a physical therapy clinic, for example. To use the adjustable physical therapy and exercise kit 10, the user or a third party, such as a physical therapist, attaches a first set of weights 16 to the first end portion 18 and the second end portion 20 of the bar 12 in accordance with a physical therapy or exercise program suitable for the user's strength, health, age, and/or physical therapy or exercise needs. For example, maybe four small weights 16 could be used for a very elderly person, whereas four large weights 16 could be used for a person of greater strength. The user then exercises with the bar 12 by manually gripping and holding the bar 12 and moving the bar 12 in an oscillating manner to cause the bar 12 to flex and the first end portion 18 and the second end portion 20 to move back and forth and thereby generate forces that cause muscle contractions in parts of the body of the user to exercise parts of the body of the user. The first set of weights 16 is then removed and a second set of weights 16 of a different weight is attached to the first end portion 18 and the second end portion 20 of the bar 12 in accordance with a physical therapy or exercise program suitable for the user's strength, health, age, and/or physical therapy or exercise needs. The user could be the same user or a different user. The user then exercises again with the bar 12 in the same manner but using the different weights 16. The preceding is one example of the many ways the bar 12 could be modified so that users of all types in all settings can use the same adjustable physical therapy and exercise kit 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An adjustable physical therapy and exercise kit comprising:

a bar being elongated and resiliently flexible;

said bar comprising a first end portion and a second end portion;

a holding structure being disposed on a central portion of said bar and configured to permit a user to manually grip and hold said bar and move said bar in an oscillating manner to cause said bar to flex and said first end portion and said second end portion to move back and forth and thereby generate forces that cause muscle contractions in parts of the body of the user to exercise parts of the body of the user;

a plurality of weights being configured to be detachably connected to said bar at said first end portion and said second end portion to cause greater flexing of said bar and greater forces on parts of the body to exercise parts of the body in a more strenuous manner than would occur with solely said bar;

each of said plurality of weights being attachable and detachable to said bar to permit a therapist or the user to vary the total weight at each of said first end portion and said second end portion in accordance with a physical therapy or exercise program suitable for the user's strength, health, age, and/or physical therapy or exercise needs;

wherein said plurality of weights comprises at least two weights each having a different weight;

wherein said bar comprises layers of hook-and-loop material configured to detachably connect with layers of hook-and-loop material on said plurality of weights; and wherein one of said layers of hook-and-loop material is disposed on opposing surfaces of each of said first end portion and said second end portion to permit detachable connection of said plurality of weights on said opposing surfaces.

2. The adjustable physical therapy and exercise kit of claim 1, wherein each of said plurality of weights comprises two layers of hook-and-loop material on opposing sides to permit detachable connection of weights in a stacked manner.

3. The adjustable physical therapy and exercise kit of claim 2, wherein said bar is in the shape of an elongated rectangular strip and said plurality of weights are in the shape of rectangular blocks.

4. The adjustable physical therapy and exercise kit of claim 3, wherein said bar and said plurality of weights comprise wood or plastic or composite material.

5. The adjustable physical therapy and exercise kit of claim 4, wherein each of said plurality of weights is 0.25 to 0.625 inch thick, is 1.25 to 1.75 inches wide, is 2 to 6 inches long, and weighs 0.5 to 1.0 ounce.

6. The adjustable physical therapy and exercise kit of claim 5, wherein said plurality of weights comprise a set of small weights, a set of medium weights being heavier than said small weights, and a set of large weights being heavier than said medium weights.

7. The adjustable physical therapy and exercise kit of claim 6, wherein:

said bar comprises a plurality of bar layers that are stackable to permit formation of a bar of different thicknesses and stiffnesses;

said holding structure comprises a wrap made of fabric or elastic material and configured to be wrapped around said plurality of bar layers to hold said plurality of bar layers together; and said wrap comprises one of: adhesive material to semi-permanently connect said plurality of bar layers together or hook-and-loop material to detachably connect said plurality of bar layers together.

8. The adjustable physical therapy and exercise kit of claim 7, wherein each of said plurality of bar layers is 0.2 to 0.3 inch thick, is 1.25 to 1.75 inches wide, is 40 to 56 inches long, and weighs 5 to 8 ounces.

9. An adjustable physical therapy and exercise kit comprising:

a bar being elongated and resiliently flexible;

said bar comprising a first end portion and a second end portion;

a holding structure being disposed on a central portion of said bar and configured to permit a user to manually grip and hold said bar and move said bar in an oscillating manner to cause said bar to flex and said first end portion and said second end portion to move back and forth and thereby generate forces that cause muscle contractions in parts of the body of the user to exercise parts of the body of the user;

a plurality of weights being configured to be detachably connected to said bar at said first end portion and said second end portion to cause greater flexing of said bar and greater forces on parts of the body to exercise parts of the body in a more strenuous manner than would occur with solely said bar;

each of said plurality of weights being attachable and detachable to said bar to permit a therapist or the user to vary the total weight at each of said first end portion and said second end portion in accordance with a physical therapy or exercise program suitable for the user's strength, health, age, and/or physical therapy or exercise needs;

wherein said bar comprises a plurality of bar layers that are stackable to permit formation of a bar of different thicknesses and stiffnesses;

wherein said holding structure comprises a wrap made of fabric or elastic material and configured to be wrapped around said plurality of bar layers to hold said plurality of bar layers together; and wherein said wrap comprises one of: adhesive material to semi-permanently connect said plurality of bar layers together or hook-and-loop material to detachably connect said plurality of bar layers together.

10. The adjustable physical therapy and exercise kit of claim 9, wherein said plurality of weights comprises at least two weights each having a different weight.

11. The adjustable physical therapy and exercise kit of claim 9, wherein said bar is in the shape of an elongated rectangular strip and said plurality of weights are in the shape of rectangular blocks.

12. The adjustable physical therapy and exercise kit of claim 9, wherein said bar and said plurality of weights comprise wood or plastic or composite material.

13. The adjustable physical therapy and exercise kit of claim 9, wherein each of said plurality of weights is 0.25 to 0.625 inch thick, is 1.25 to 1.75 inches wide, is 2 to 6 inches long, and weighs 0.5 to 1.0 ounce.

14. The adjustable physical therapy and exercise kit of claim 9, wherein said plurality of weights comprise a set of small weights, a set of medium weights being heavier than said small weights, and a set of large weights being heavier than said medium weights.

15. The adjustable physical therapy and exercise kit of claim 9, wherein each of said plurality of bar layers is 0.2 to 0.3 inch thick, is 1.25 to 1.75 inches wide, is 40 to 56 inches long, and weighs 5 to 8 ounces.

16. An adjustable physical therapy and exercise kit comprising:

a bar being elongated and resiliently flexible;

said bar comprising a first end portion and a second end portion;

a holding structure being disposed on a central portion of said bar and configured to permit a user to manually grip and hold said bar and move said bar in an oscillating manner to cause said bar to flex and said first end portion and said second end portion to move back and forth and thereby generate forces that cause muscle contractions in parts of the body of the user to exercise parts of the body of the user;

a plurality of weights being configured to be detachably connected to said bar at said first end portion and said second end portion to cause greater flexing of said bar and greater forces on parts of the body to exercise parts of the body in a more strenuous manner than would occur with solely said bar;

each of said plurality of weights being attachable and detachable to said bar to permit a therapist or the user to vary the total weight at each of said first end portion and said second end portion in accordance with a physical therapy or exercise program suitable for the user's strength, health, age, and/or physical therapy or exercise needs;

wherein said bar comprises layers of hook-and-loop material configured to detachably connect with layers of hook-and-loop material on said plurality of weights; and wherein one of said layers of hook-and-loop material is disposed on opposing surfaces of each of said first end portion and said second end portion to permit detachable connection of said plurality of weights on said opposing surfaces.

17. The adjustable physical therapy and exercise kit of claim 16, wherein each of said plurality of weights comprises two layers of hook-and-loop material on opposing sides to permit detachable connection of weights in a stacked manner.

* * * * *